US011374341B2

(12) United States Patent
Akagi

(10) Patent No.: US 11,374,341 B2
(45) Date of Patent: Jun. 28, 2022

(54) BOX-SHAPED CONNECTION TERMINAL WITH OVERLAPPING LOCKING FEATURES FOR PREVENTING DEFORMATION

(71) Applicant: Yazaki Corporation, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/173,299

(22) Filed: Feb. 11, 2021

(65) Prior Publication Data

US 2021/0257763 A1 Aug. 19, 2021

(30) Foreign Application Priority Data

Feb. 18, 2020 (JP) ..... JP2020-024963

(51) Int. Cl.
*H01R 13/11* (2006.01)
*H01R 4/18* (2006.01)

(52) U.S. Cl.
CPC ..... *H01R 13/11* (2013.01); *H01R 4/185* (2013.01)

(58) Field of Classification Search
CPC .... H01R 12/716; H01R 13/11; H01R 13/447; H01R 13/5231; H01R 13/6273; H01R 13/8582; H01R 4/185
USPC ..... 439/884
See application file for complete search history.

(56) References Cited

U.S. PATENT DOCUMENTS 6,283,803 B1 * 9/2001 Sato ..... H01R 13/113 439/852
6,679,738 B2 * 1/2004 Nimura ..... H01R 13/114 439/752.5
8,974,256 B2 * 3/2015 Okano ..... H01R 13/11 439/852
10,230,189 B2 * 3/2019 Droesbeke ..... H01R 43/16
10,297,940 B2 * 5/2019 Tanikawa ..... H01R 13/4223
2002/0077000 A1 * 6/2002 Nimura ..... H01R 43/16 439/852
2003/0096533 A1 * 5/2003 Kojima ..... H01R 13/114 439/595
2013/0244510 A1 * 9/2013 Jakoplic ..... H01R 4/22 439/877

FOREIGN PATENT DOCUMENTS

JP 2000-243498 A 9/2000

* cited by examiner

*Primary Examiner* — Peter G Leigh
(74) *Attorney, Agent, or Firm* — Sughrue Mion, PLLC

(57) ABSTRACT

In a connection terminal including a box-shaped connection portion that has a bottom wall, one side wall and another side wall that are erected on both sides of the bottom wall, and a ceiling wall, the ceiling wall has a lower ceiling wall obtained by bending the one side wall toward the other side wall, and an upper ceiling wall obtained by bending the other side wall toward the one side wall at an upper bent portion and is superposed above the lower ceiling wall, a protrusion is provided on a side of the lower ceiling wall close to the lower bent portion, and a locking portion is provided on a side of the upper ceiling wall close to the lower bent portion.

3 Claims, 2 Drawing Sheets

BOX-SHAPED CONNECTION TERMINAL WITH OVERLAPPING LOCKING FEATURES FOR PREVENTING DEFORMATION

CROSS-REFERENCE TO RELATED APPLICATIONS

The present application is based on, and claims priority from Japanese Patent Application No. 2020-024963, filed on Feb. 18, 2020, the entire contents of which are incorporated herein by reference.

TECHNICAL FIELD

The present application relates to a connection terminal.

BACKGROUND

A connection terminal of JP 2000-243498 A includes a box-shaped connection portion having a rear surface wall as a bottom wall, side surface walls as one side wall and the other side wall provided on both sides of the rear surface wall in a width direction, and a front surface wall as a ceiling wall arranged on a side of the side wall surfaces opposite to the rear surface wall.

SUMMARY

In the connection terminal of JP 2000-243498 A, a locking projecting piece that projects from the ceiling wall toward the side wall is bent toward the side wall and is fitted into a notch of the side wall.

However, in the fitting of the locking projecting piece into the notch, there is a concern that, in a case where an external force such as ultrasonic waves is applied, the fitting of the locking projecting piece into the notch comes off so that the box-shaped connection portion is opened.

An object of the present application is to provide a connection terminal capable of preventing the opening of a box-shaped connection portion.

A connection terminal according to an embodiment includes a box-shaped connection portion that has a bottom wall, one side wall and another side wall that are erected on both sides of the bottom wall in a width direction, and a ceiling wall that is arranged on a side of the one side wall and the other side wall facing the bottom wall; a lower bent portion obtained by bending an end of the one side wall toward the other side wall; and an upper bent portion obtained by bending an end of the other side wall toward the one side wall, in which the ceiling wall has a lower ceiling wall that is bent toward the other side wall at the lower bent portion, and an upper ceiling wall that is bent toward the one side wall at the upper bent portion and is superposed above the lower ceiling wall, a protrusion that projects toward the one side wall is provided on a side of the lower ceiling wall close to the lower bent portion, and a locking portion which extends parallel to the one side wall and into which the protrusion is inserted is provided on a side of the upper ceiling wall close to the lower bent portion.

It is preferable that an accommodation recess that accommodates the locking portion is provided to the lower bent portion.

According to the above configuration, it is possible to provide a connection terminal capable of preventing the opening of a box-shaped connection portion.

DETAILED DESCRIPTION

Figure 1:
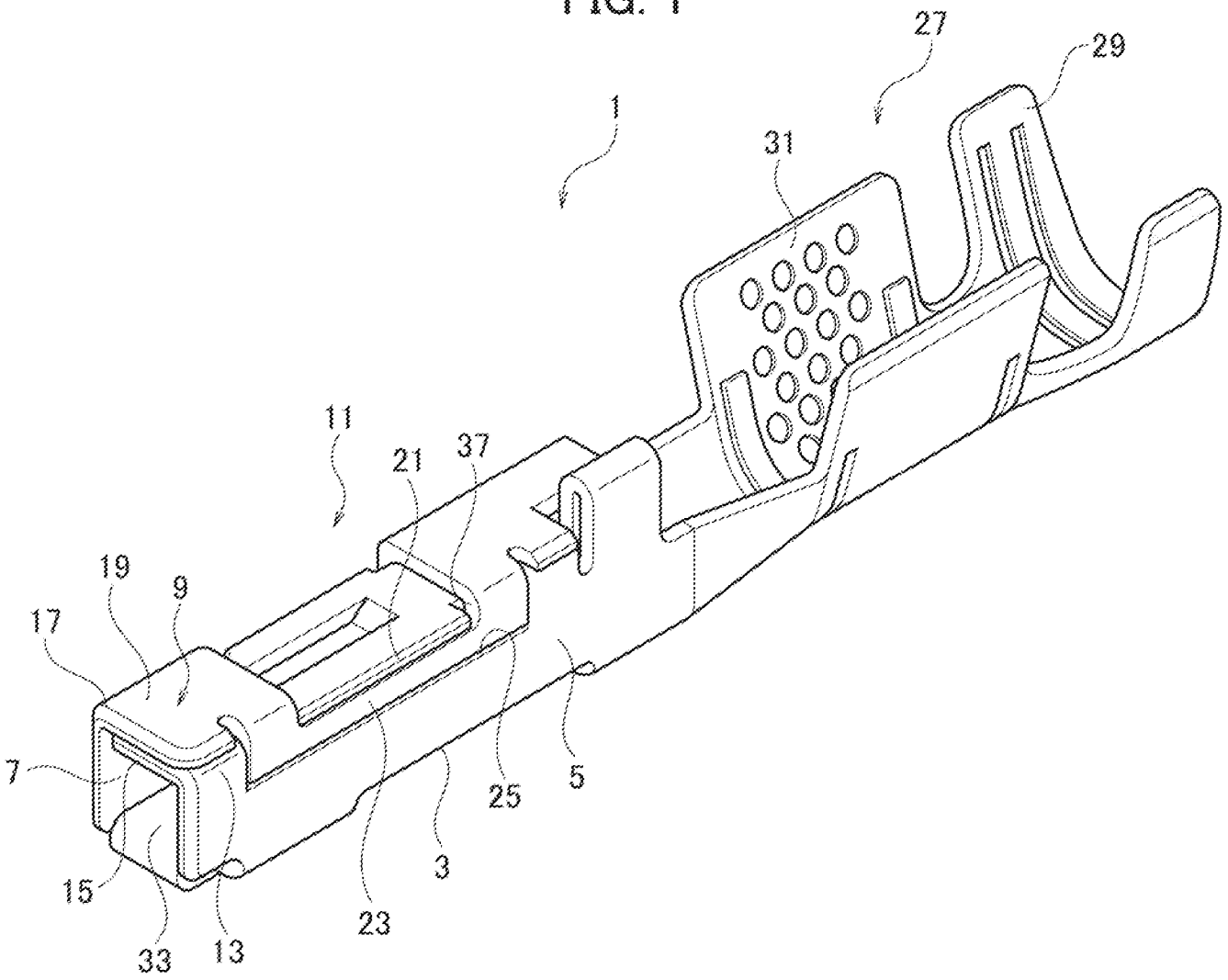
FIG. 1 is a perspective view of a connection terminal according to an embodiment.

Hereinafter, a connection terminal according to an embodiment will be described in detail with reference to the drawings. The dimensional ratios in the drawings are exaggerated for convenience of explanation and may differ from the actual ratios.

A connection terminal 1 according to the present embodiment includes a box-shaped connection portion 1 having a bottom wall 3, one side wall 5 and the other side wall 7 erected on both sides of the bottom wall 3 in a width direction, and a ceiling wall 9 arranged on a side of the one side wall 5 and the other side wall 7 facing the bottom wall 3.

The ceiling wall 9 has a lower ceiling wall 15 obtained by bending the one side wall 5 toward the other side wall 7 at a lower bent portion 13, and an upper ceiling wall 19 which is obtained by bending the other side wall 7 toward the one side wall 5 at an upper bent portion 17 and is superposed above the lower ceiling wall 15 (superposed on a side which is opposite to a side facing the bottom wall 3 and is away from the bottom wall 3).

A protrusion 21 which projects toward the one side wall 5 is provided on a side of the lower ceiling wall 15 close to the lower bent portion 13, and a locking portion 23 which extends parallel to the one side wall 5 and into which the protrusion 21 is inserted is provided on a side of the upper ceiling wall 19 close to the lower bent portion 13.

An accommodation recess 25 that accommodates the locking portion 23 is provided in the lower bent portion 13.

Figure 2:
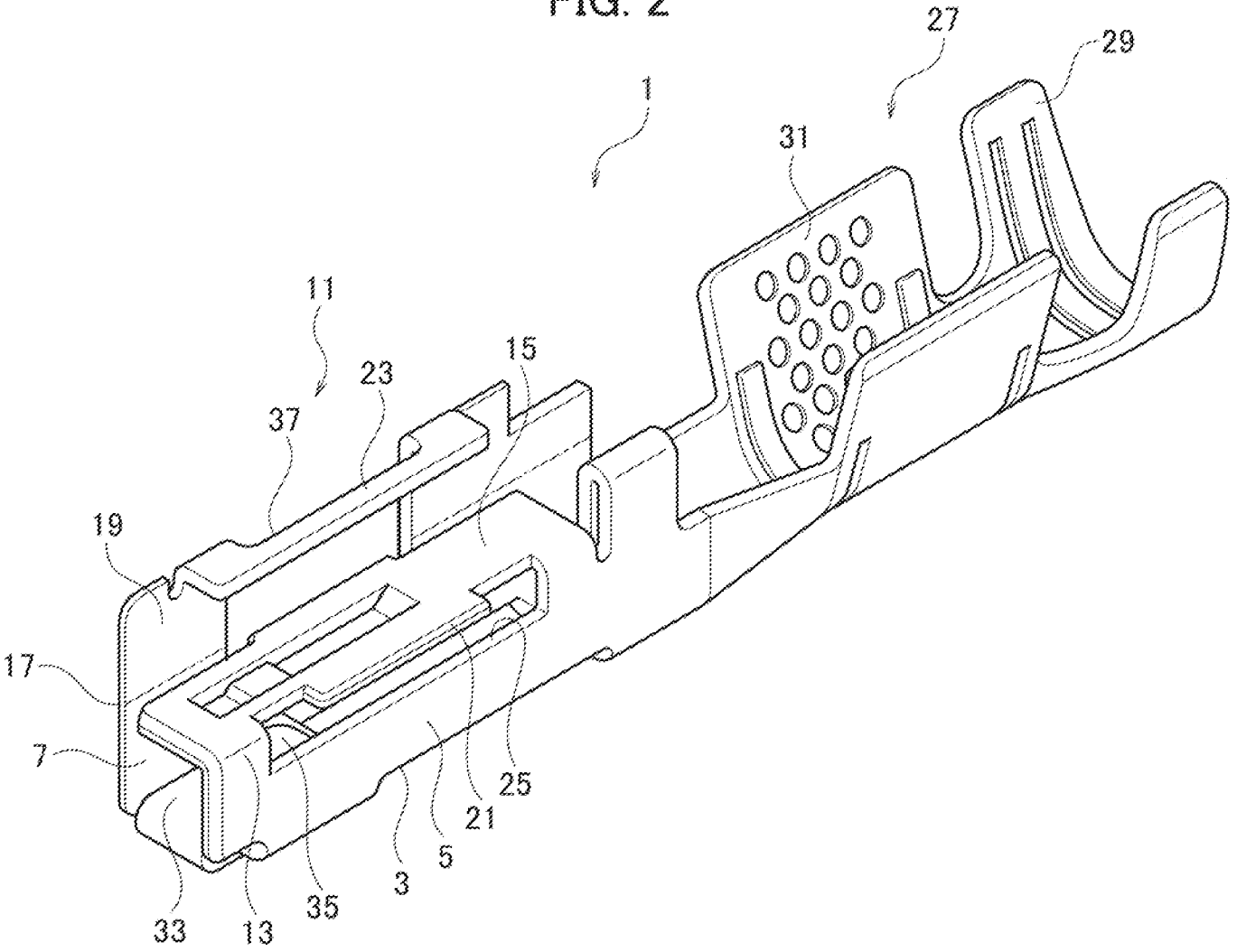
FIG. 2 is a perspective view in a case where an upper ceiling wall of the connection terminal according to the embodiment is opened.

As illustrated in FIGS. 1 and 2, the connection terminal 1 is formed by performing punching or bending processing on a single plate made of a conductive material to form one member in which a cable connection portion 27 and the connection portion 11 are continuous. The cable connection portion 27 includes a sheath crimping portion 29 and a core wire crimping portion 31.

The sheath crimping portion 29 is composed of a pair of crimping pieces, and crimps a sheath portion of the cable at a terminal portion of the cable (not illustrated) connected to a power supply, equipment, or the like. By crimping the sheath crimping portion 29 to the sheath portion of the cable, the connection terminal 1 is fixed to the cable.

The core wire crimping portion 31 is composed of a pair of crimping pieces provided between the connection portion 11 and the sheath crimping portion 29, and crimps a core wire portion exposed from the sheath portion of the cable at the terminal portion of the cable. By crimping the core wire crimping portion 31 to the core wire portion of the cable, the connection terminal 1 is electrically connected to the cable.

The connection portion 11 is composed of a female connection portion formed in a box shape by bending processing. The box-shaped connection portion 11 includes the bottom wall 3, the one side wall 5, and the other side wall 7, and the ceiling wall 9.

The bottom wall 3 is formed of one member continuous with the core wire crimping portion 31 of the cable connection portion 27. An opening-side end of the bottom wall 3 is an elastic piece 33 which is folded back toward the inside of the box-shaped connection portion 11 and can be elastically deformed inside the box-shaped connection portion 11. The elastic piece 33 is provided with a contact portion 35 that is brought into contact with a mating connection portion of a male mating terminal (not illustrated) having a tab-shaped mating connection portion, by the urging force of the elastic piece 33.

The one side wall 5 and the other side wall 7 are formed of one member continuous with the bottom wall 3 and the core wire crimping portion 31 of the cable connection portion 27. The one side wall 5 and the other side wall 7 are erected by perpendicularly bending upward each of the ends of the bottom wall 3 on both sides in the width direction. The elastic piece 33 is arranged between the one side wall 5 and the other side wall 7.

The ceiling wall 9 is formed of one member continuous with the one side wall 5 and the other side wall 7. The ceiling wall 9 is arranged to face the bottom wall 3 by bending the end of each of the one side wall 5 and the other side wall 7 on a side opposite to the bottom wall 3. The ceiling wall 9 includes the lower ceiling wall 15 and the upper ceiling wall 19.

The lower ceiling wall 15 is formed of one member continuous with the one side wall 5. The lower ceiling wall 15 is arranged in parallel with the bottom wall 3 by perpendicularly bending the end of the one side wall 5 toward the other side wall 7 at the lower bent portion 13. The elastic piece 33 is arranged between such a lower ceiling wall 15 and the bottom wall 3.

The upper ceiling wall 19 is formed of one member continuous with the other side wall 7. The upper ceiling wall 19 is arranged in parallel with the lower ceiling wall 15 to be superposed above the lower ceiling wall 15 by perpendicularly bending the end of the other side wall 7 toward the one side wall 5 at the upper bent portion 17. By superimposing the upper ceiling wall 19 on the lower ceiling wall 15 in this way, the ceiling wall 9 has a double structure, and it is possible to improve the proof stress against the external force applied in a direction of opening the ceiling wall 9.

A tab-shaped mating connection portion of a mating terminal is inserted into such a box-shaped connection portion 11 through the opening. The mating connection portion of the mating terminal inserted into the connection portion 11 is brought into contact with the contact portion 35 by the urging force of the elastic piece 33. The connection terminal 1 and the mating terminal are electrically connected by the contact between the mating connection portion and the contact portion 35.

In such a box-shaped connection portion 11, there is a concern that the ceiling wall 9 may be opened not only by an external force such as insertion of the mating connection portion but also by an external force such as ultrasonic waves. Therefore, the protrusion 21 and the locking portion 23 are provided to the box-shaped connection portion 11.

The protrusion 21 is formed of one member continuous with the lower ceiling wall 15 to protrude from the end of the lower ceiling wall 15 on a side close to the lower bent portion 13 toward the one side wall 5. The protrusion 21 has a shape to project from the end of the lower ceiling wall 15 on a side close the lower bent portion 13 toward the one side wall 5 by providing the accommodation recess 25 described later in the lower bent portion 13. Therefore, the projecting end of the protrusion 21 does not project from the outer surface of the one side wall 5 toward the outside of the connection portion 11.

The locking portion 23 is perpendicularly bent at the end of the upper ceiling wall 19 on a side close to the lower bent portion 13, and extends parallel to the one side wall 5. The locking portion 23 has a locking recess 37 formed to divide the upper ceiling wall 19 in a length direction of the connection portion 11, and is formed to connect the upper ceiling wall 19 divided by the locking recess 37. In such a locking portion 23, when the upper ceiling wall 19 is bent at the upper bent portion 17 and the upper ceiling wall 19 is superposed on the lower ceiling wall 15, the protrusion 21 is inserted into the locking recess 37.

In a state where the protrusion 21 is inserted into the locking recess 37 of the locking portion 23, the protrusion 21 is engaged to be caught in the locking recess 37 in an opening direction of the upper ceiling wall 19. Therefore, even if an external force such as ultrasonic waves acts to open the upper ceiling wall 19, the protrusion 21 is caught in the locking recess 37 so that the upper ceiling wall 19 is not opened.

The accommodation recess 25 is provided to the lower bent portion 13. The accommodation recess 25 is a hole formed through the one side wall 5 and the lower ceiling wall 15. The locking portion 23 is accommodated in such an accommodation recess 25 in a state where the protrusion 21 is inserted into the locking recess 37 of the locking portion 23.

In a state where the locking portion 23 is accommodated in the accommodation recess 25, the outer surface of the locking portion 23 is prevented from projecting from the outer surface of the one side wall 5 toward the outside of the connection portion 11. Therefore, in a state where the protrusion 21 is inserted into the locking recess 37 of the locking portion 23, the outer surface of the locking portion 23 does not project from the outer surface of the one side wall 5, and thus the enlargement of the connection portion 11 can be suppressed.

In such a connection terminal 1, the ceiling wall 9 has the lower ceiling wall 15 obtained by bending the one side wall 5 toward the other side wall 7 at the lower bent portion 13, and the upper ceiling wall 19 which is obtained by bending the other side wall 7 toward the one side wall 5 at the upper bent portion 17 and is superposed above the lower ceiling wall 15. Therefore, the ceiling wall 9 can have a double structure with the lower ceiling wall 15 and the upper ceiling wall 19, and it is possible to improve the proof stress against the external force in the opening direction applied to the connection portion 11.

The protrusion 21 which projects toward the one side wall 5 is provided on a side of the lower ceiling wall 15 close to the lower bent portion 13, and the locking portion 23 which extends parallel to the one side wall 5 and into which the protrusion 21 is inserted is provided on a side of the upper ceiling wall 19 close to the lower bent portion 13. In a state where the protrusion 21 is inserted into the locking portion 23, the protrusion 21 is engaged to be caught in the locking portion 23 in the opening direction of the upper ceiling wall 19. Therefore, even if an external force such as ultrasonic waves acts to open the upper ceiling wall 19, the protrusion 21 is caught in the locking portion 23 so that the upper ceiling wall 19 can be prevented from being opened.

Therefore, in such a connection terminal 1, the ceiling wall 9 is not opened due to an external force such as ultrasonic waves, and thus the opening of the box-shaped connection portion 11 can be prevented.

Since the accommodation recess 25 that accommodates the locking portion 23 is provided to the lower bent portion 13, in a state where the protrusion 21 is inserted into the locking portion 23, the locking portion 23 does not project to the outside of the connection portion 11, and thus the enlargement of the connection portion 11 can be suppressed.

Next, a comparative example will be described. In a connection terminal according to the comparative example, a locking projecting piece having a rice scoop shape is formed on an edge of a front surface wall, and a notch having a shape into which the locking projecting piece is fitted is formed on a side surface wall. The locking projecting piece is bent toward the side surface wall, and is fitted into the notch. By the locking projecting piece being fitted into the notch, the opening of the connection portion when the mating terminal is inserted into the box-shaped connection portion is prevented.

In the connection terminal according to the comparative example, the locking projecting piece that projects from the ceiling wall toward the side wall is bent toward the side wall, and is fitted into the notch on the side wall.

However, in the fitting of the locking projecting piece into the notch, there is a concern that, in a case where an external force such as ultrasonic waves is applied, the fitting of the locking projecting piece into the notch comes off so that the box-shaped connection portion is opened.

Although the embodiment has been described above, the embodiment is not limited thereto, and various modifications can be made within the scope of the gist of the embodiment.

The connection terminal according to the embodiment is electrically connected to the cable, but the embodiment is not limited thereto, for example, as long as the connection terminal has a box-shaped connection portion such as electrically connecting the connection terminal to a substrate, the connection terminal may be in any form.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connection terminal comprising:

a box-shaped connection portion that has a bottom wall, one side wall and another side wall that are erected on both sides of the bottom wall in a width direction, and a ceiling wall that is arranged on a side of the one side wall and the other side wall facing the bottom wall;

a lower bent portion obtained by bending an end of the one side wall toward the other side wall; and an upper bent portion obtained by bending an end of the other side wall toward the one side wall, wherein the ceiling wall has a lower ceiling wall that is bent toward the other side wall at the lower bent portion, and an upper ceiling wall that is bent toward the one side wall at the upper bent portion and is superposed above the lower ceiling wall, a protrusion that projects toward the one side wall is provided on a side of the lower ceiling wall close to the lower bent portion, and a locking portion, which extends parallel to the one side wall, is provided on a side of the upper ceiling wall close to the lower bent portion, the locking portion having a locking recess into which the protrusion is inserted.

2. The connection terminal according to claim 1, wherein an accommodation recess that accommodates the locking portion is provided to the lower bent portion.

3. The connection terminal of claim 2, wherein the locking portion, received in the accommodation recess, extends parallel to and coplanar with the one side wall so as to not project outwardly of the one side wall.

* * * * *